US010667979B2

(12) United States Patent
Caccese et al.

(10) Patent No.: US 10,667,979 B2
(45) Date of Patent: Jun. 2, 2020

(54) STYLIZED ADAPTIVE MOBILITY DEVICE

(71) Applicant: University of Maine System Board of Trustees, Orono, ME (US)

(72) Inventors: Vincent Caccese, Levant, ME (US); Elizabeth DePoy, Newburgh, ME (US); Stephen Gilson, Newburgh, ME (US); Ryan Michael Beaumont, Topsham, ME (US); James Everett Alexander, Jr., Greenfield Twp., ME (US)

(73) Assignees: University of Maine System Board of Trustees, Orono, ME (US); R.M. Beaumont Corp., Topsham, ME (US)

( * ) Notice: Subject to any disclaimer, the term of this patent is extended or adjusted under 35 U.S.C. 154(b) by 42 days.

(21) Appl. No.: 16/086,716

(22) PCT Filed: Mar. 23, 2017

(86) PCT No.: PCT/US2017/023770
§ 371 (c)(1),
(2) Date: Sep. 20, 2018

(87) PCT Pub. No.: WO2017/172473
PCT Pub. Date: Oct. 5, 2017

(65) Prior Publication Data

US 2019/0099319 A1 Apr. 4, 2019

Related U.S. Application Data

(60) Provisional application No. 62/315,935, filed on Mar. 31, 2016, provisional application No. 62/425,246, filed on Nov. 22, 2016.

(51) Int. Cl.
*A61H 3/04* (2006.01)

(52) U.S. Cl.
CPC ..... *A61H 3/04* (2013.01); *A61H 2003/046* (2013.01); *A61H 2201/0161* (2013.01);
(Continued)

(58) Field of Classification Search
CPC ..... A61H 3/04; A61H 3/06
See application file for complete search history.

(56) References Cited

U.S. PATENT DOCUMENTS 2,654,416 A 10/1953 Maniscalco
4,239,248 A 12/1980 Ewers
(Continued)

FOREIGN PATENT DOCUMENTS

KR 101032113 B1 5/2011

OTHER PUBLICATIONS

PCT International Search Report and Written Opinion, Application No. PCT/US17/23770, dated Jun. 16, 2017.

*Primary Examiner* — John D Walters
*Assistant Examiner* — James J Triggs
(74) *Attorney, Agent, or Firm* — MacMillan, Sobanski & Todd, LLC

(57) ABSTRACT

An adaptive mobility device enables disabled users to ambulate with more security. The device includes a frame including two rear forks for a pair of rear wheels, and a pivotable front fork and wheel, steerable with a steering mechanism that alters the front wheel angle in response to pivoting of the forearms support bar. The support bar may optionally contain forearm rests on which the user may support his or her weight while reaching the handgrips for steering the device. The steering mechanism may provide for adjustment of the steering ratio.

20 Claims, 7 Drawing Sheets

(52) U.S. Cl.
CPC ..... *A61H 2201/0192* (2013.01); *A61H 2201/1635* (2013.01); *A61H 2201/5061* (2013.01)

(56) References Cited

U.S. PATENT DOCUMENTS

| | | | | |
|---|---|---|---|---|
| 5,020,560 | A * | 6/1991 | Turbeville | A61H 3/04 135/67 |
| 5,657,783 | A * | 8/1997 | Sisko | A61H 3/00 135/66 |
| 6,003,532 | A | 12/1999 | Pi | |
| 6,546,291 | B2 | 4/2003 | Merfeld et al. | |
| 6,743,156 | B1 * | 6/2004 | Jacques, II | A61H 3/04 135/65 |
| 7,001,313 | B1 | 2/2006 | Crnkovich | |
| 7,111,856 | B1 | 9/2006 | Graham | |
| 7,866,677 | B1 | 1/2011 | Rothstein et al. | |
| 7,938,413 | B2 | 5/2011 | Anderson | |
| 8,608,184 | B2 | 12/2013 | Janis et al. | |
| 8,608,479 | B2 | 12/2013 | Liu | |
| 8,678,425 | B2 | 3/2014 | Schaaper et al. | |
| 8,752,658 | B2 | 6/2014 | Kurek | |
| 8,961,186 | B2 | 2/2015 | LoSasso | |
| 9,149,408 | B2 | 10/2015 | Karlovich | |
| 9,566,207 | B1 * | 2/2017 | Ratliff | A61H 3/04 |
| 2003/0228959 | A1 | 12/2003 | Perlstein | |
| 2004/0201191 | A1 | 10/2004 | Jacques, II et al. | |
| 2008/0061529 | A1 | 3/2008 | Schmautz | |
| 2008/0079230 | A1 | 4/2008 | Graham | |
| 2012/0043730 | A1 | 2/2012 | Walther et al. | |
| 2015/0076797 | A1 | 3/2015 | Alink | |
| 2017/0112706 | A1 * | 4/2017 | Bruk | A61H 3/04 |
| 2019/0254918 | A1 * | 8/2019 | Fellingham | A61H 3/04 |

* cited by examiner

STYLIZED ADAPTIVE MOBILITY DEVICE

The present invention relates generally adaptive mobility devices and, in particular, to a three-wheeled adaptive device enabling mobility for ambulatory persons needing or wanting stabilization. This application is a national phase application of international application PCT/US17/23770, filed under the authority of the Patent Cooperation Treaty on Mar. 23, 2017; which claims priority to U.S. Provisional Application No. 62/315,935, filed under 35 U.S.C. § 111(b) on Mar. 31, 2016, and U.S. Provisional Application No. 62/425,246, filed under 35 U.S.C. § 111(b) on Nov. 22, 2016. The entire content of each of the aforementioned applications is expressly incorporated herein by reference for all purposes.

BACKGROUND OF THE INVENTION

Bicycles provide transportation and mobility for many, but some people are disabled or unstable on bicycles. Tricycles provide added stability, but allow only for a cycling motion, not a walking or jogging motion of the user. A walker is also used to provide stability and mobility to disabled persons and/or persons undergoing rehabilitation. Such walkers generally have four legs with either 4 wheels or 2 wheels and two other legs, sometimes having tennis balls or skis on the non-wheeled legs. Walkers are designed to provide some stability and assistance, and offer some limited load transfer capability.

Rollators are wheeled version of walkers and come in 3 or 4 wheel models. Like walkers, they provide for a limited amount of weight transfer for an upright user and are less than optimal when stability assistance is desired on uneven terrains. The following U.S. Patent documents are illustrative of known upright support devices: U.S. Pat. Nos. 7,111,856; 7,494,138; 7,866,677; 8,215,652; 8,596,658; 9,289,347; and U.S. Pat. No. 9,314,395. However, walkers and rollators are generally not designed for distance mobility, fitness training, or outdoor activities on uneven terrain.

The present invention aims to solve this gap and provides a mobility device adapted so that a user may walk or jog and yet still derive stability from the device that may be necessary depending on the user's particular needs. This is especially useful on uneven terrains.

SUMMARY OF THE INVENTION

The ambulatory device's unique design and construction allows a disabled or unsteady person to ambulate with more ease and security, particularly over uneven terrain. The stylized ambulatory mobility device (SAMD) comprises:

a frame having right and left frame portions joined at a forward vertex defining a midline plane and joined by a cross member extending between the right and left frame portions rearward from the vertex, the frame defining a space for a user rearward of the cross member;

a pair of rear forks, one attached to each of the right and left frame portions for supporting a pair of rear wheels rotatable about an axis approximately normal to the midline plane;

a front fork assembly having a central shaft pivotably supported by the frame at said vertex, and forks extending from the central shaft for rotatably supporting a front wheel steerable by altering the pivot angle of the front fork assembly;

a user weight support system including a forearm support bar mounted to a post pivotably supported by the cross member, and at least one hand grip mounted in a position suitable for gripping with a user's hand when the user's forearm is supported on the forearm support bar; and a steering mechanism for altering the pivot angle of the front fork assembly in response to a pivoting motion of the forearm support bar.

In general terms, the steering mechanism comprises a tie link (or cable) that causes pivoting of the fork assembly when the forearm support bar is pivoted. When the link (or cable) is connected at any of multiple radially-displaced positions on the forearm support or on a crank lever pivotable with the forearm support bar, or at any of multiple radially-displaced positions on the front fork assembly, the steering mechanism is "adjustable." Thus, in some embodiments, the steering mechanism is an adjustable steering mechanism capable of adjusting the steering sensitivity, i.e. the steering ratio.

The tri-wheeled SAMD provides stability for users. It is adjustable for persons of different stature and different support needs. In some embodiments, the device employs large diameter wheels relative to the height of the forearm support. For example the wheel diameter may be 40% to 90% of the height of the device; for example more than 50%, or more than 60% of the height, as defined herein. In some embodiments, the SAMD includes a forearm rest attached to forearm support bar for supporting the weight of a user. A key feature of the SAMD is that a user may transfer some or most of his or her weight (load) to the device itself, by resting a forearm or elbow on the arm rest. In some embodiments the amount of load transferred may be monitored and/or quantified by means of a suitable sensor, such as a strain gauge.

A further advantage is the facile steerable nature of the present invention, without losing the ability to transfer load to the device frame. The device is made of lightweight materials, making it easy to handle by compromised individuals, and, in some embodiments, includes weighted wheels in order to keep the center of gravity low to provide additional stability.

In some embodiments, the SAMD includes a suspension system to absorb the shocks of an uneven or bumpy terrain. For example, the rear fork may be attached to the frame with a hinge and a spring/shock absorber may act as a suspension system.

BRIEF DESCRIPTION OF THE DRAWINGS

The accompanying drawings, incorporated herein and forming a part of the specification, illustrate the present invention in its several aspects and, together with the description, serve to explain the principles of the invention. In the drawings, the thickness of the lines, layers, and regions may be exaggerated for clarity.

Figure 1:
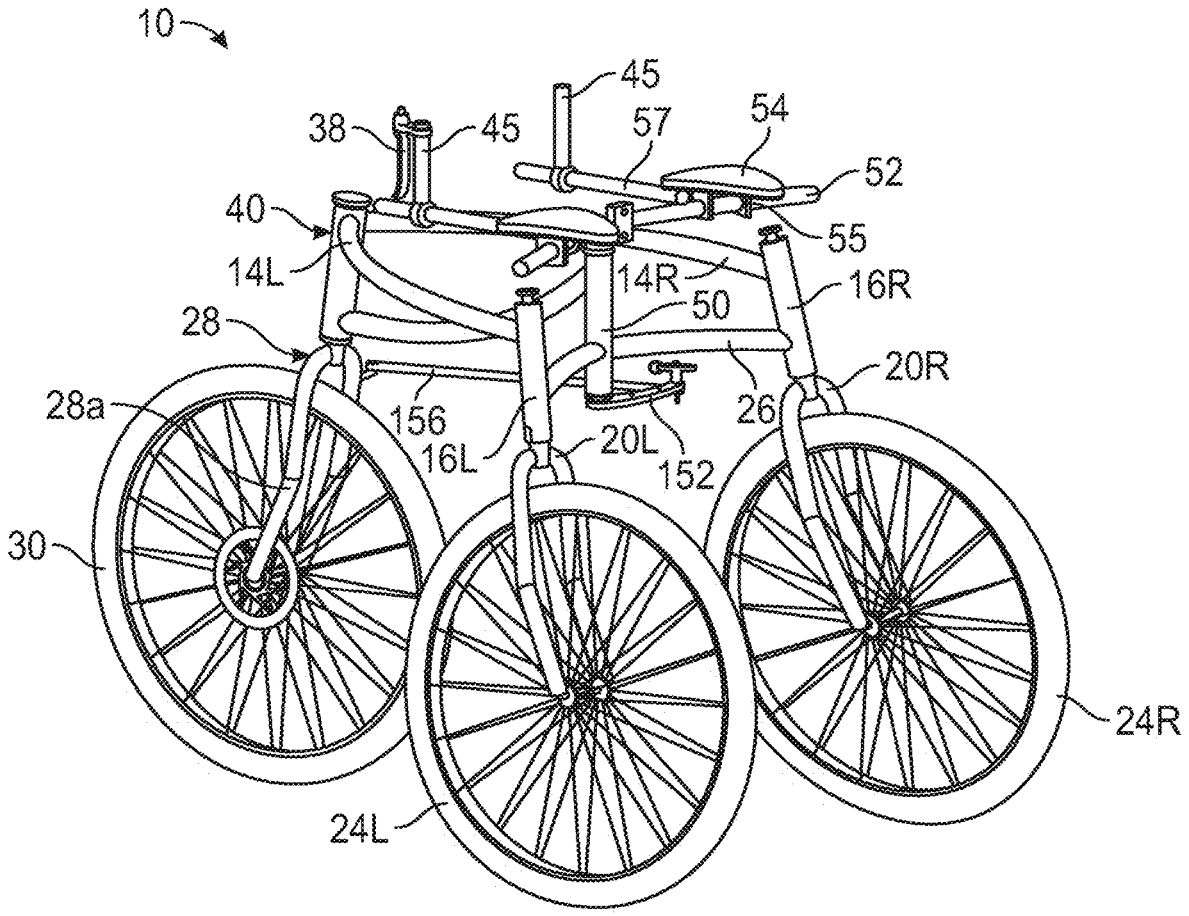
FIG. 1 is a perspective view illustrating a first embodiment of the adaptive device.

Various aspects of this invention will become apparent to those skilled in the art from the following detailed description of the preferred embodiment, when read in light of the accompanying drawings.

DETAILED DESCRIPTION

Unless defined otherwise, all technical and scientific terms used herein have the same meaning as commonly understood by one of ordinary skill in the art to which the invention belongs. Although any methods and materials similar or equivalent to those described herein can be used in the practice or testing of the present invention, the preferred methods and materials are described herein. All references cited herein, including books, journal articles, published U.S. or foreign patent applications, issued U.S. or foreign patents, and any other references, are each incorporated by reference in their entireties, including all data, tables, figures, and text presented in the cited references.

Numerical ranges, measurements and parameters used to characterize the invention—for example, angular degrees, quantities of ingredients, polymer molecular weights, reaction conditions (pH, temperatures, charge levels, etc.), physical dimensions and so forth—are necessarily approximations; and, while reported as precisely as possible, they inherently contain imprecision derived from their respective measurements. Consequently, all numbers expressing ranges of magnitudes as used in the specification and claims are to be understood as being modified in all instances by the term "about." All numerical ranges are understood to include all possible incremental sub-ranges within the outer boundaries of the range. Thus, a range of 30 to 90 units discloses, for example, 35 to 50 units, 45 to 85 units, and 40 to 80 units, etc. Unless otherwise defined, percentages are wt/wt %.

Adaptive Device

The adjective "adaptive," as used herein, refers to devices that are re-engineered or reconfigured or modified to be more user-friendly for persons with disabilities of any nature or degree. A "mobility device" is any wheeled aid for use in mobilizing or transporting an individual, such as a bicycle, tricycle, or wheelchair. Such a device will have components for interacting with the ground or terrain and components for interacting with the user; and either or both components may be "adaptive." "Disabled" as used herein means does not require any officially established disability, such as might be recognized by the Americans with Disabilities Act (ADA), but rather refers to a user that is compromised in some way with regard to balance, stability, ability to bear weight on his or her own legs, or just needing additional security.

FIGS. 1 to 4 illustrate a first embodiment of the adaptive device 10 in an open or "ready to use" position or configuration. The device 10 comprises a frame in two halves or portions 12L on the left side and 12R on the right side. For clarity, all positional descriptors used herein (such as right and left, up and down, inward and outward, front and back, forward and rearward, fore and aft, and the like) are to be understood from the perspective of a user unless otherwise stated. In many cases, reference numerals will indicate both halves of the frame using L or R designations, but may omit these if the descriptive statement is generic to both halves. For brevity, the left side will be described in detail, it being understood that the right side has equivalent but complementary components, except where noted otherwise.

Figure 2A:
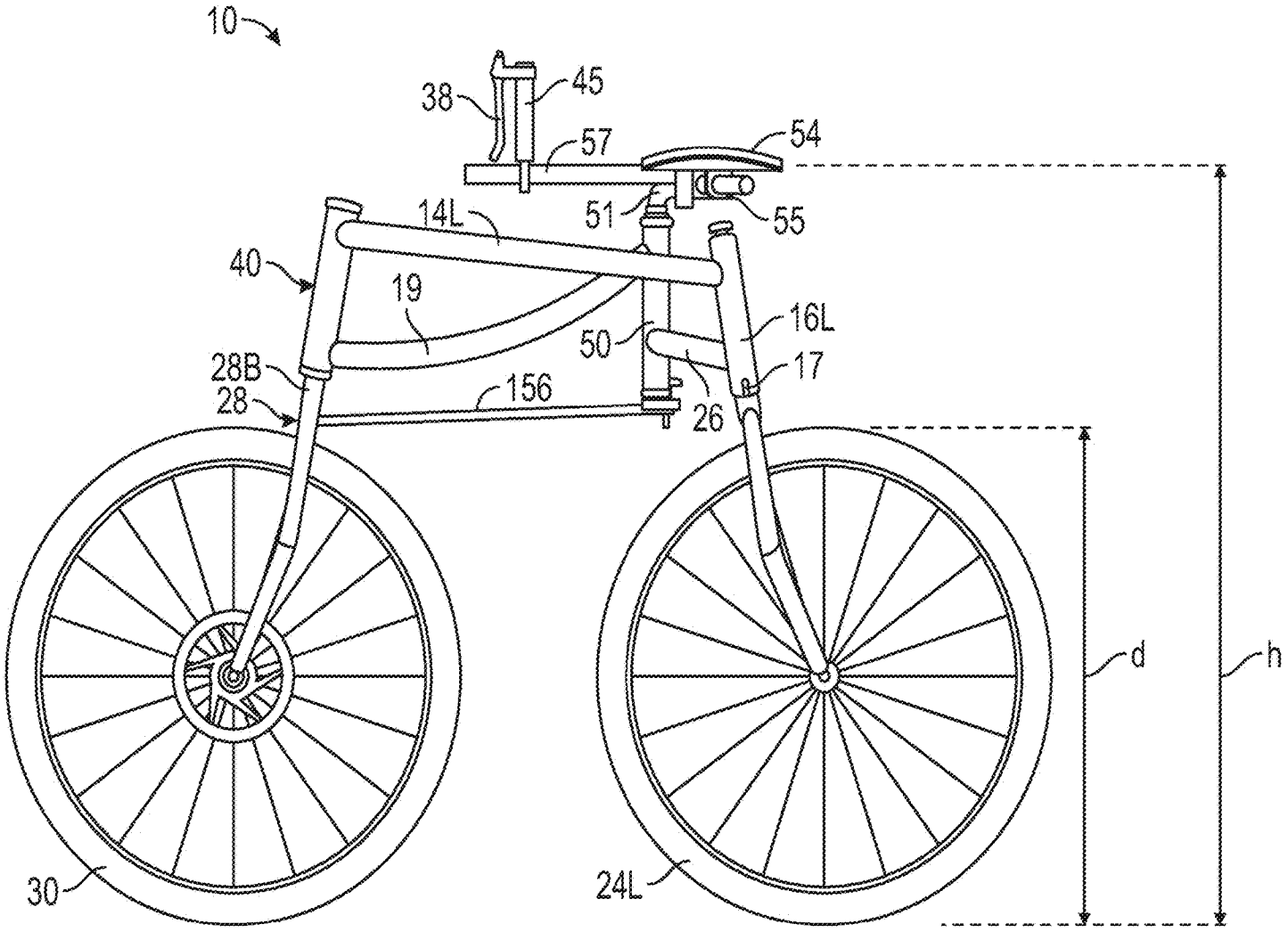
FIGS. 2A and 2B, respectively, are a side and front elevation views of the embodiment of FIG. 1.
Figure 2B:
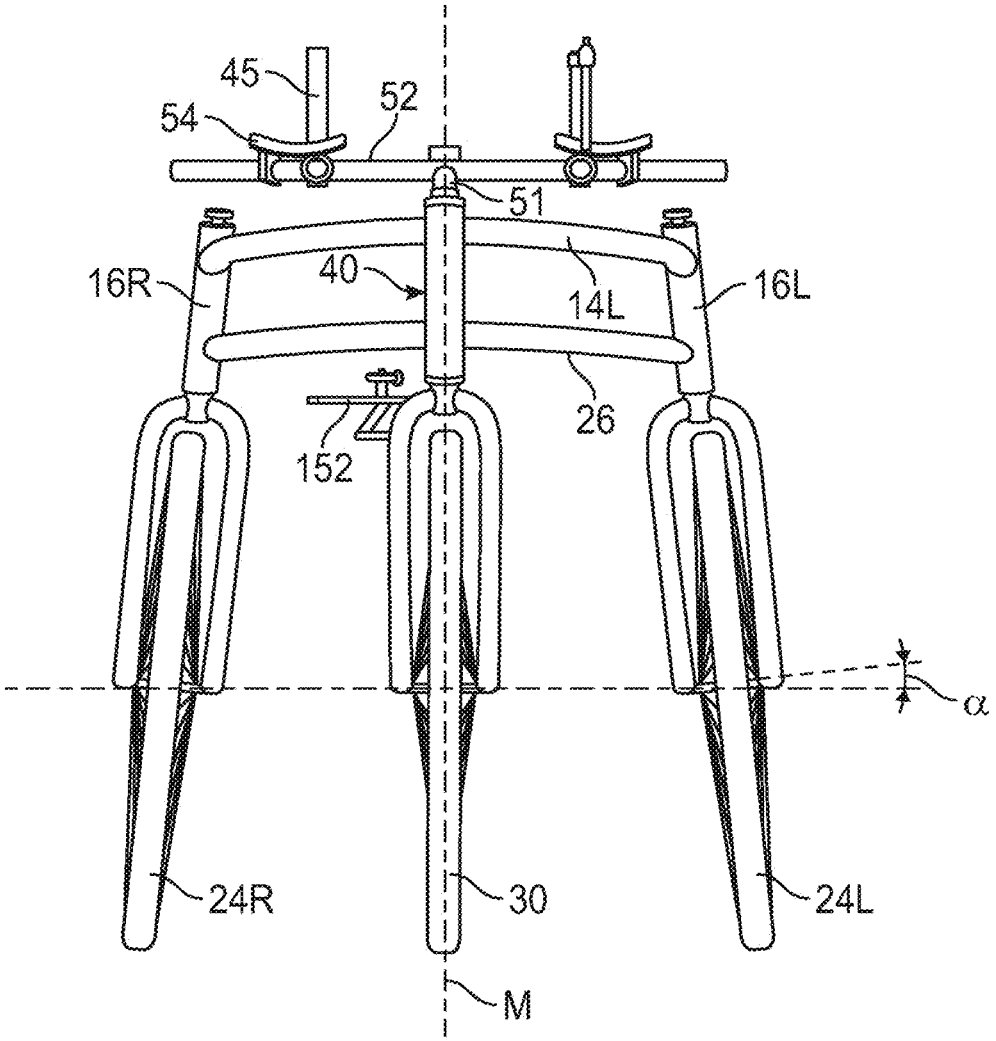

The frame 12L comprises one or more transverse members 14L, and an upright stem or post 16L. The stem 16L will generally be straight, but the members 14L may be arcuate as seen in FIG. 2B. Near the lower end of the post 16L, a left rear fork 20L extends for rotatably supporting left rear wheel 24L. In the embodiment of FIGS. 1-4 the rear forks 24 may be inserted into the bottom end of a hollow interior of posts 16, and extend in a downward, rearward, and outward direction generally coaxially with the post 16. However, to prevent pivoting of the rear fork 24 about the axis of the post 16, a slot 17 and key mechanism may be used. This downward configuration of the rear forks (FIGS. 1-4) provides stability and better weight transfer to the rear wheels of the device.

Figure 5:
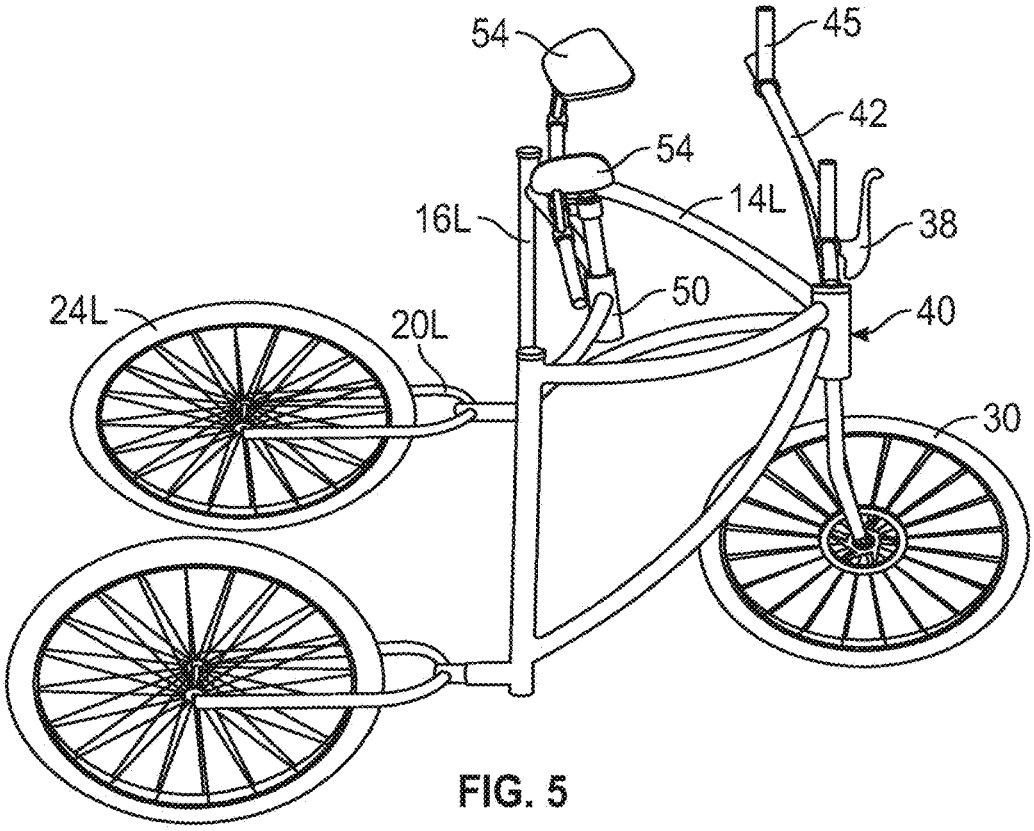
FIG. 5 is a perspective view illustrating a second embodiment of the adaptive device.
Figure 6:
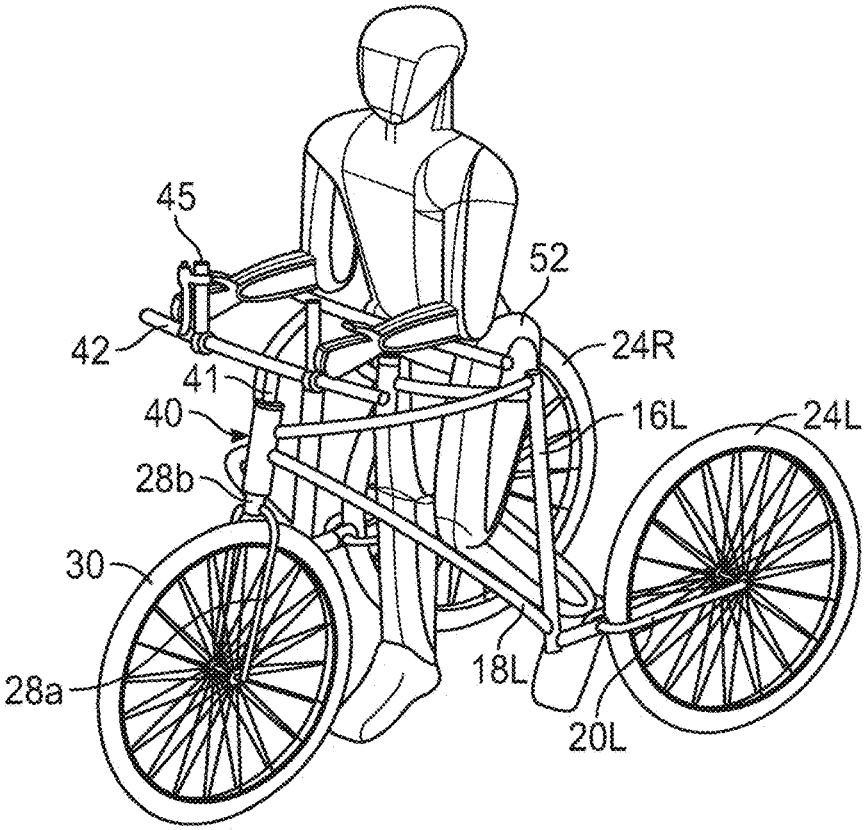
FIG. 6 is a perspective view illustrating how a user might interact with the embodiment of FIG. 5.

In the embodiment of FIGS. 5-7, frame 12 is larger, having a longer post 16 and an additional, angled transverse member 18L attached to a lower end of the post 16. In these embodiments, the rear fork 20 extends rearwardly from a lower end of post 16. Rear fork 20 may optionally be hingedly attached to the frame 12 for pivoting in an up-and-down direction. A suspension system comprising a spring and shock absorber mechanism (not shown) may connect the rear fork and the frame to restrict the pivoting motion so as to absorb and dampen the unevenness of the terrain. Alternatively, the rear fork 20L may be rigidly secured to the frame and not hinged, and thus no spring for shock absorbing is necessary, but flexing may still occur. In a rigid attachment, the rear fork 20 may be removeably mounted to the frame such as by insertion of a tubes of with a first diameter into (or over) a stub of slightly smaller (larger) diameter, the two being held together by a spring detent or pin; or by a bracket and bolts. In a variation, the rear fork 20L may be rigidly secured to the frame, such as by a weld. The rearward-directed configuration of the rear forks (FIGS. 5-7) provides stability by a longer wheel base, and can also provide a bit shock absorbance by flexing of the frame or by a spring mechanism.

The right frame has corresponding frame members 14R, 16R, (18R), and 20R, and the right rear fork 20R rotatably supports a right rear wheel 24R. The rear wheels 24 are rotatable about an axis approximately normal (i.e. perpendicular) to the midline plane, M. As seen in FIG. 2B, the frame posts 16 may be angled or canted slightly relative to a vertical midline plane, M, to provide greater stability. In this regard, "approximately normal" to the midline axis allows for a deviation angle, a, of up to about 15 degrees, i.e. from 75 to 90 degrees relative to the midline plane. If canted for stability, the cant angle relative to vertical may be from 1 to about 15 degrees, for example from about 5 to about 10 degrees.

The two frame halves 12L and 12R are joined together at the forward vertex 40, where transverse members 14L and 14R meet. In some embodiments this is a rigid or fixed connection, such as a weld. In other embodiments, the two halves 12L and 12R are joined in foldable clamshell halves at a tubular pivot found at the vertex 40. A transverse cross member 26 extends from one frame member 12 L to the other 12 R, such as the cross member 26 between transverse members 14L and 14R. The cross member 26 ensures the device remains consistently and stably in its open position during use. In rigid frame construction, the cross member 26 may be welded in place, whereas in foldable embodiments, the cross member 26 may be releasably attached using, for example, clamps or bolts with easily removable wingnuts. Cross member 26 may be angled or curved as shown so that a portion toward the midline is more forward than the outward portions attached to the right and left frames 12R and 12L. This curvature defines a space rearward of the cross member 26 that is suitable for accommodating a user, as will be described below.

The vertex 40 joins the clamshell halves of the frame 12, and also supports a pivotable front fork 28 assembly that contains a rotatable front wheel 30. The vertex 40 may comprise a typical bicycle head tube and headset, which may be threaded or threadless, and will generally contain bearings and races for facile pivoting. As with typical bicycle forks, two blades or tines 28*a* divide to either side of the wheel and hold an axle for the rotatable wheel 30. The tines 28*a* attach to a shoulder or cross piece which is attached to a central post 28*b* that is pivotable within the vertex 40, as in known bicycle headsets. The device 10 is steerable by pivoting the front fork 28 assembly along with its rotatable wheel 30, about the axis of the central post 28*b* with the housing of the frame vertex 40 as will be described momentarily.

As part of the adaptive features of the adaptive mobility device, cross member 26 houses or is attached to a second headset or pivot tube 50 near the midline M that is functionally similar to that found at vertex 40 housing the central post 28*b*. It may also contain similar bearings and races. Pivot tube 50 houses a post 51 extending upwards and attached to forearm support bar 52. Forearm support bar 52 extends transversely right and left approximately perpendicular to the post 51. Additional frame members, such as midline support member 19, may provide additional strength and rigidity to frame as it supports the pivot tube 50.

The forearm support bar 52 may be fitted with one or two forearm rests 44, mounted to the forearm support bar 52 spaced apart between the post 51 and the right and left ends of the support bar 52. The forearm rests 54 may be planar disk-like structures, or they may be elongated and U-shaped or otherwise curved to comfortably accommodate the forearm and/or elbow of the user in the concavity of the rest. (See FIGS. 1-3). The forearm support bar 52 and rests 54 are an adaptive feature that allows the user to transfer some or most of his or her weight from his or her legs to the device. The forearm rests 54 may be padded for comfort.

The forearm rests 54 may be mounted to the forearm support bar 52 by means of a clamp or bracket 55 that permits adjustments of several types. The brackets 55 may be moved laterally right or left to account for greater or lesser spacing between elbows or forearms, depending on the width of the user. Secondly, the brackets 55 may allow for a rotation about a transverse axis (i.e. a "pitch" motion in aeronautical terms) to cause the forearm rests to deviate from horizontal if desired. The brackets 55 may be secured to the forearm support bar 52 by a two-piece, clamp-like portion that grasps the bar and can quickly be tightened into a desired position by knurled knob screws, or by any other suitable securing means. The bracket 55 or clamp may also provide for a "yaw-like" pivoting motion of the forearm rests 54, as described below in connection with the embodiment of FIGS. 5-7.

As shown in the embodiment of FIGS. 1-4, the brackets 55 and/or the forearm rests 54 may further include forwardly-directed extension bars 57 that move laterally and pivot with the forearm rests 54. These extension bars serve as a mounting support for hand grips 45 that extend generally vertically from the bars 57. Handgrips 45 need not be directly vertical, but may be angled from about 0 to about 30 degrees relative to vertical. Optional angles may lean inwardly or forward, or both relative to the contact point with the steering bar 42. In some embodiments, the handgrip 45 simply clamps onto the extension bar, thus providing an easy rotation adjustment about a longitudinal axis (i.e. an aeronautical "roll" rotation). Additionally, the distance between the forearm rest 54 and hand grip 45 may be adjustable to accommodate user having shorter or longer forearms. In an alternative arrangement, the forward extension bar 57 itself may be bent or shaped with at least one angled section that can serve as a handgrip, and adjustment for spacing or rotation may be made at the bracket 55.

Pitch rotation is particularly desirable if the rest 54 is U-shaped. This allows the user to comfortably cradle the forearm and/or elbow in the concavity of the U-shaped rests 54 while simultaneously reaching forward to grip the upright handgrips 45 with the hands, the forearm and upper arm forming an angle of roughly 90 degrees, but ranging from about 60 to about 120 degrees.

In embodiments designed for users having the use of both hands and arms, the rests 54 and the handgrips 45 may each be spaced between about 5 to about 15 inches from the midline in right and left directions. In general, the grips 45 may be spaced apart about the same distance or slightly closer to center than the forearm rests 54. In embodiments designed for users having the use of only one arm, a single rest 54 may desirably be spaced closer to the midline for better distribution of weight.

In the alternative embodiment of FIGS. 5-7, handgrips 45 may be mounted on and extend generally upward from a handle bar 42 that is secured to a steering post 41 rigidly connected to the central post 28*b* of the front fork 28 assembly for pivoting motion therewith. The handlebar 42 extends transversely right and left approximately perpendicular to the central post 28*b*, with or without an offsetting stem portion 43 that may be altered for steering sensitivity or to adjust for arm length of a user.

Brake levers 38 are much like typical bicycle brake levers and can be mounted to the handgrip 45 and connected to cables that draw brake calipers together around the rim of the wheels 24, 30. If one brake level is used it may control the front wheel 30. If two brake levers are used, they may control the rear wheels 24, or both the front and rear wheels. The brake calipers, levers and cabling are well known and need not be described in detail here. In still other embodiments, the brake levers and calipers are optional, and the device may be stopped by user effort.

In particular embodiments of the SAMD, a load sensor may be employed to monitor and/or quantify the amount of weight or load a user transfers to the device. For example, in one embodiment the sensor may be associated with the suspension system and may monitor the angular deflection of a hinged fork or the linear displacement of a shock absorber piston or spring. In another embodiment, the load sensor may monitor the pressure, tension or displacement at the forearm rest. A conventional strain gauge may be adapted for this purpose. Quantifying the amount of load transfer may facilitate monitoring the progress of a rehabilitation user, who might seek gradually to reduce the amount of load transfer over time during rehabilitation. Other reasons for quantification of load transfer may be apparent as well.

The adaptive device 10 of the invention may be made of lightweight materials to make it easier for a disabled person to use. For example, the frame 12 may be made from aluminum, graphite, carbon fiber, magnesium or titanium. Forearm rests 34 may be padded for comfort and may be adjustable as to angle as well as height. Grips may be soft polymer or foam padded. The spring and shock absorber, if used, may be adjustable, or may come in different size or strength models, to accommodate users needing to transfer more or less weight to the adaptive device.

Wheels may be very similar to bicycle wheels, using a hub and spokes to support a rim and tire, and may come in varying diameters from about 20 inches to about 36 inches, usually from about 24 inches to about 30 inches, to accommodate different users. Tires may be inflatable or a solid polymer-type not susceptible to flats. In some embodiments the wheels may be weighted to maintain a lower center of gravity for the entire device. The wheels are removable in most embodiments.

Large wheels may afford greater comfort and stability over uneven terrain Consequently, in some embodiments the wheels have a diameter that is more than 40% of the height of the SAMD, for example more than 45% of the height, more than 50% of the height, more than 55% of the height, or more than 60% of the height, and up to 90% of the height of the device. For the purpose of this diameter-to-height ratio, illustrated best in FIG. 2A, diameter, d, is determined with the tire included, and height, h, is determined as the distance from the ground to the point on which the user would transfer his or her load weight to the device, when the device (if adjustable) is at its lowest height setting. In the case of a typical rollator, height is thus measured from the ground to the hand grips; whereas, in the SAMD device described herein, height is measured from the ground to the forearm supports.

In some embodiments of the device (not shown) the device 10 may be folded and stored compactly. The rear wheels 24 may be removed so that pivotable rear forks 20 may be folded up approximately parallel to frame stem 16 or removable forks may be removed. Additionally, the two frame halves 12R and 12L may be folded inward toward the midline M, pivoting at the clamshell attachment about the vertex 40. Optionally the front fork may be folded so that the front wheel occupies the remaining space between the frame halves.

Adjustable Steering Mechanisms

A steering mechanism is required for pivoting the front fork 28 assembly and front wheel 30 in response to a pivoting motion of the forearm support bar 52. A "steering ratio" as used herein refers to the degrees of turn or pivot of the forearm support bar divided by the degrees of turn or pivot of the front wheel. Steering ratio is a sensitivity adjustment that is possible with adjustable steering mechanisms. At slower speeds (e.g. walking) a lower steering ratio may be desirable for improved, more sensitive directional control, but at higher speeds (e.g. running) a less sensitive, higher steering ratio may be desired to prevent oversteering. There are multiple embodiments for accomplishing this.

Figure 3:
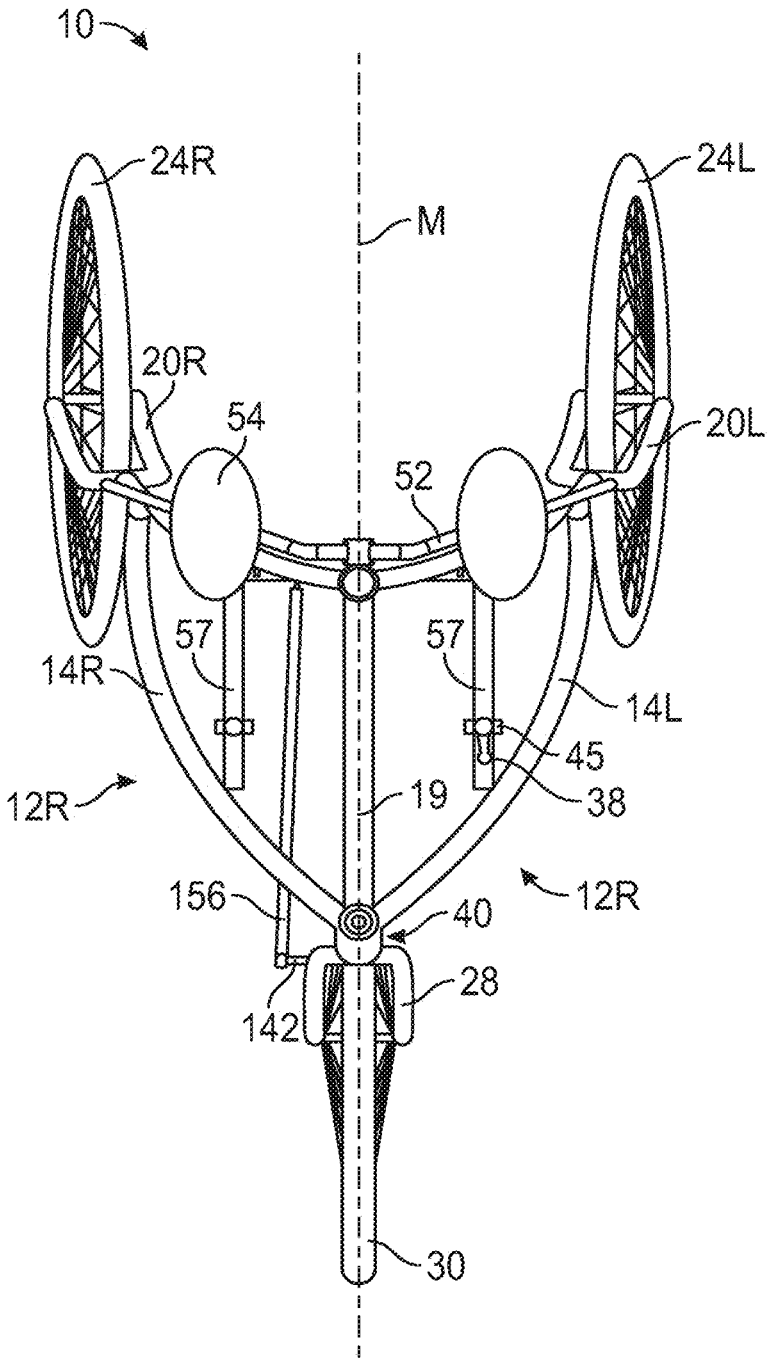
FIG. 3 is a top view of the embodiment of FIG. 1.
Figure 4B:
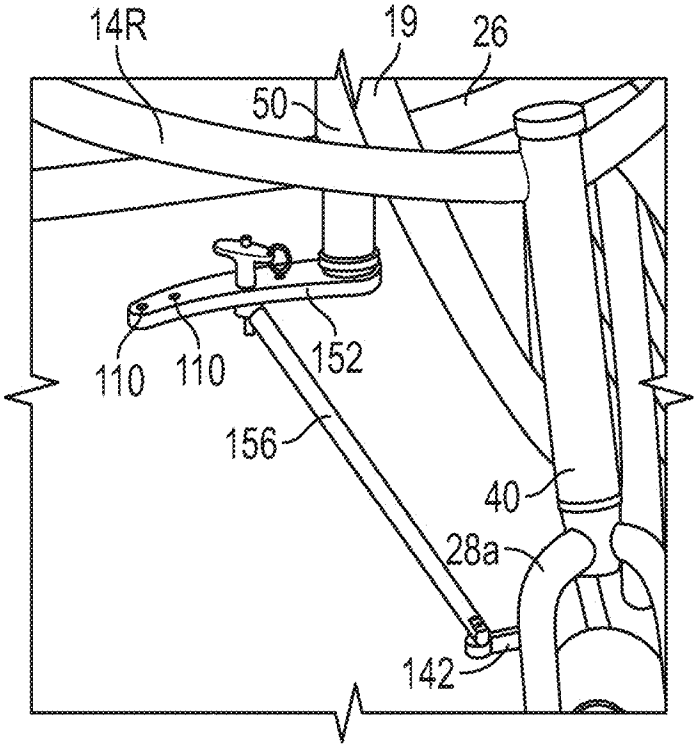
FIGS. 4A and 4B show the detail of the adjustable steering mechanism of the embodiment of FIG. 1.
Figure 4A:
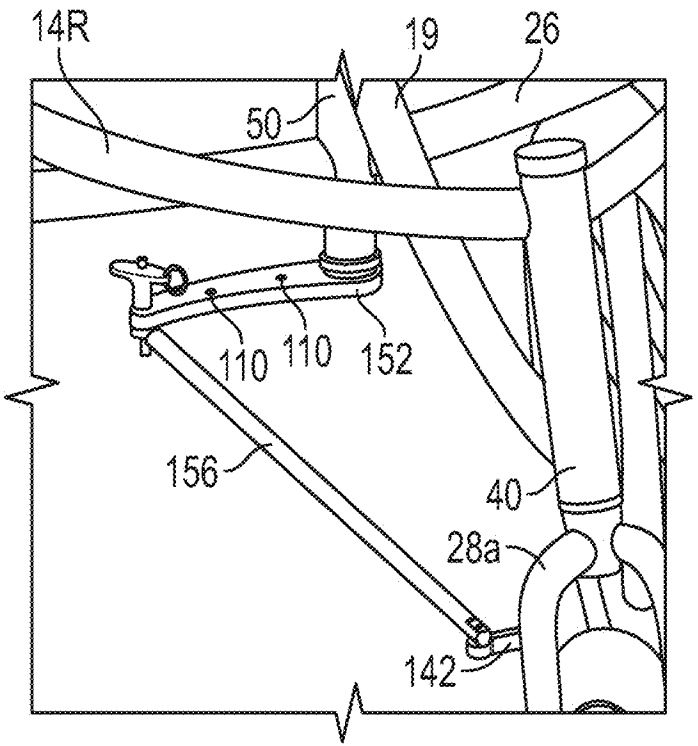

In the embodiment of FIGS. 1-4 and shown in detail in FIGS. 4A and 4B, the adjustable steering mechanism 100 comprises a crank arm 152 secured to the bottom end of post 51 on which the forearm support bar 52 is mounted, and extending laterally; e.g. roughly parallel to the forearm support bar 52. The crank arm 152 thus pivots relative to the frame 12 in synchrony with the forearm support bar 52. The crank arm 152 contains a plurality of connection points, such as holes 110, each successive connection point having a greater radial offset or displacement from the axis of pivot of the post 51.

A similar crank or lever arm is secured to and extends laterally from any portion of the front fork 28 assembly; for example, the stub or lever arm 142 shown secured to the right fork tine 28*a*. A tie rod or tie link 156 connects the crank arm 152 with the lever arm 142. In this arrangement, pivoting the forearm support bar 52 causes rotation of the post 51, which causes pivoting of the crank arm 152, which pushes (or pulls) the tie link 156 to cause a corresponding pivot in lever arm 142 and the front fork 28 assembly to which it is secured, which turns the front wheel 30. It is understood that the connection points must allow free pivot of the tie link 156 relative to the crank arm 152 and the lever arm 142. Lock pins, rivets, hinge pins, bolts with lock nuts, etc. may all serve such a purpose. By connecting the tie link 156 to a crank arm connection point 110 that is farther displaced radially from the center, as shown in FIG. 4A, a more sensitive, lower steering ratio is achieved. Conversely, a less sensitive, higher steering ratio is achieved by connecting the tie link 156 to a crank arm connection point 110 that is radially closer to the center, as shown in FIG. 4B.

For ease of adjusting the steering ratio, a convenient quick-release lock pin may be employed at the connection points 110, Suitable quick-release connections include, for example, a clevis pin, a cotter pin, a cotterless pin, a "D" or square link pin, lynch pins, etc. A bolt and captive nut may also be used. It should be understood that either the crank arm 152 or the lever arm 142 may contain the multiple radially-displaced connection points 110, but the general triangular nature of the device 10 makes it more palatable to place the longer torque lever rearward at the location of the crank arm 152, and to place the shorter torque lever on the front fork assembly, e.g. at the location of the lever arm 152.

An alternative steering mechanism is shown in FIGS. 5-7. Much of the device here is similar to that described above and that description is not repeated. Steering is accomplished via a steering handlebar 42 that is connected like a conventional bicycle handlebar in a headset. The handlebar 42 is secured to a stem or steering post 41 that is fixed to the central post 28*b* of the front fork 28 assembly, so that the front fork 28 (with its front wheel 30) turns synchronously with the handlebar 42. The handlebar 42 and forearm support bar 52 are shown with similar shapes and are approximately parallel to one another, but this is not essential to the invention so long as each has a radial arm extension that provides torquing leverage for the steering post 41 and forearm support post 51, respectively. Provided they have a component of radial offset for leverage, the arms 42, 52 may assume any upward or downward bend or any forward or rearward bend to achieve a particular design or fit feature.

One or more linkages 56L and/or 56R may optionally be used to link the two pivoting bars 42, 52 together to move in unison. The links may be connected anywhere along the lengths of the bars 42, 52, such as at one or both outboard ends. The links 56, if used, should also pivot relative to the bars 42, 52 for reasons already described. See FIGS. 7A and 7B. The links may be adjustable or variable, so that adjustment to the stem offsets or adjustment to the height of the steering handlebar 42 and forearm support bar 52 may be made without requiring different linkage lengths. Elastic linkages or air cylinders such as those used as door closers or trunk lid dampers can be adapted for this purpose.

To adjust the steering ratio in this embodiment, only one linkage 56 is used and it will have variable connection points radially displaced along either the handlebar 42 or the forearm support bar 52, analogous to those described above for the crank arm 152. Although the linkage 56 may be adjustable in length to accommodate different height adjustments of the bars 42, 52, one bar heights are selected, the linkage 56 should remain at a fixed length in order to provide adjustment of a steering ratio as described above. Since the user's forearms resting on the forearm support and grasping the handgrips 45 on the handlebar 52 could act as a pseudo linkage, the actual linkage 56 must be rigid enough to overcome this to adjust steering ratios.

Figure 7B:
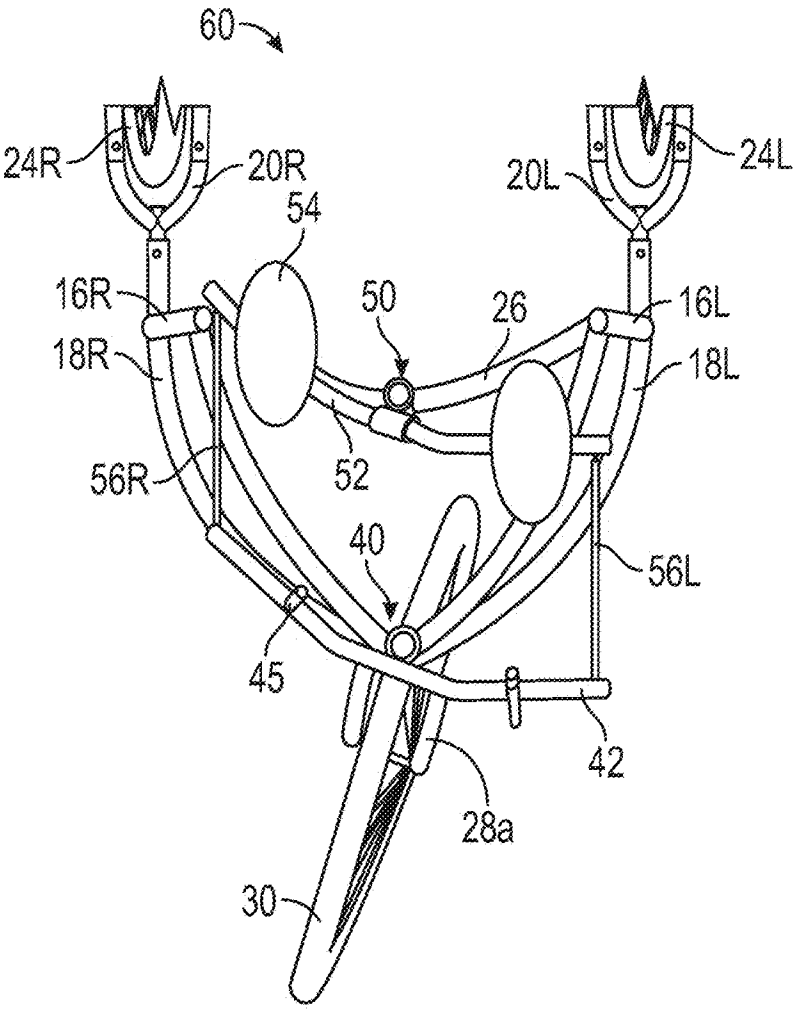
FIGS. 7A and 7B show the detail of the adjustable steering mechanism of the embodiment of FIG. 5.
Figure 7A:
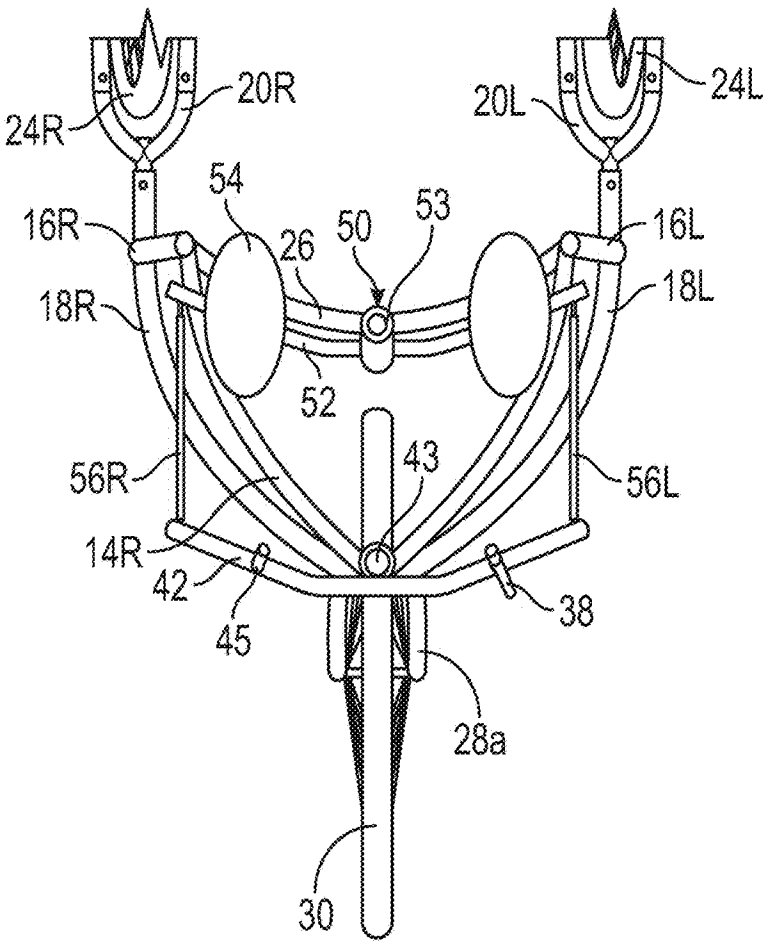

As best seen in FIGS. 6, 7A and 7B the device 10 in use maintains a straight, forward course when the elbows (and hands) are in the same position fore and aft (FIG. 7A). To turn right (FIG. 7B), the user moves the left arm (and hand) forward in an arc path to push the left grip 45 forward and torque the steering handlebar 42 and connected fork 28 in a clockwise (from above) direction to turn the wheel 30 to the right. Returning the elbows to the equal fore-aft position will return the wheel 30 to the straight position of FIG. 5A. Steering left is accomplished analogously by pushing the right arm forward.

In FIG. 7B, the advantage of pivotable forearm rests 54 can be seen. In pushing a grip forward (or rearward), the alignment of forearm from elbow to hand maintains its position in a line roughly parallel to the forward-aft direction. In geometric terms, the forearms may be considered two sides of a quadrilateral, and the handlebar and forearm support bar (assuming straight bars 42, 52) form the other two sides. In a forward-moving posture, the quadrilateral is essentially a rectangle; when turning right or left, the quadrilateral becomes a parallelogram, causing the angles at the corners to change. Pivotable rests 54 allow for this angle change relative to the forearm support bar 52, while maintaining proper alignment of forearm in the fore-aft direction. Pivoting rests are not as important for planar disk-like rests, or for the embodiment of FIG. 1-4.

For the embodiment of FIGS. 1-4, the device 10 in use maintains a straight, forward course when the elbows (and hands) are in the same position fore and aft. In this case a rotational movement of the forearm support bar 52, along with is forward extension bars 57 and handgrips 45, will turn the device right or left as above.

Optionally in some embodiments, vertex 40 (and/or tubular pivot 50 described below) may be fitted with another adaptive feature to cause the steering bar 42 and wheel 30 to return to a central position until a steering force is applied by a user. Such an adaptive feature may include any of several well-known detent mechanisms: for example, bearing surfaces that have a depression or are slightly eccentric, or torque spring mechanisms.

It should be appreciated that the device 10 is adjustable in many respects for users of different stature and size. First, frame size and wheel diameter may be varied for shorter or taller users. For a given frame and wheel diameter, the height of the forearm rests 54 may be adjustable relative to the ground, for example, by use of mounting posts that slide vertically into clamps on the support bar 52 as best shown in FIG. 3, or through the use of interchangeable support posts of different lengths. The forearm rests 54 may be slideably mounted to the forearm support bar 52, such as with slotted brackets; or, alternatively, this adjustment may be accomplished by use of "stems" of different lengths.

The foregoing description of the various aspects and embodiments of the present invention has been presented for purposes of illustration and description. It is not intended to be exhaustive of all embodiments or to limit the invention to the specific aspects disclosed. Obvious modifications or variations are possible in light of the above teachings and such modifications and variations may well fall within the scope of the invention as determined by the appended claims when interpreted in accordance with the breadth to which they are fairly, legally and equitably entitled.

What is claimed is:

1. An adaptive mobility device comprising:

a frame having right and left frame portions joined at a forward vertex defining a midline plane and joined by a cross member extending between the right and left frame portions rearward from the vertex, the frame defining a space for a user rearward of the cross member;

a pair of rear forks, one attached to each of the right and left frame portions for supporting a pair of rear wheels rotatable about an axis approximately normal to the midline plane;

a front fork assembly having a central shaft pivotably supported by the frame at said vertex, and forks extending from the central shaft for rotatably supporting a front wheel steerable by altering the pivot angle of the front fork assembly;

a user weight support system including a forearm support bar mounted to a post pivotably supported by the cross member, and at least one hand grip mounted in a position suitable for gripping with a user's hand when the user's forearm is supported on the forearm support bar; and a steering mechanism for altering the pivot angle of the front fork assembly in response to a pivoting motion of the forearm support bar, wherein the wheels have a diameter that is more than 40% of the height of the device.

2. The adaptive mobility device of claim 1 further comprising an adjustable steering mechanism configured to adjust the steering ratio.

3. The adaptive mobility device of claim 1 wherein the steering system further comprises a crank arm attached to the bottom of the forearm support post for pivot motion therewith; a lever arm attached to the front fork assembly for pivot motion therewith; and a tie link connecting the crank arm to the lever arm.

4. The adaptive mobility device of claim 3 wherein the tie link connects at one of on either the crank arm or the lever arm to adjust the steering ratio.

5. The adaptive mobility device of claim 1 wherein the wheels have a diameter that is more than 50% of the height of the device.

6. The adaptive mobility device of claim 1 further comprising at least one U-shaped forearm support rest mounted to the forearm support bar.

7. The adaptive mobility device of claim 6 further comprising two forearm support rests mounted to the forearm support bar, one on either side of the midline and each spaced between about 5 and 15 inches from the midline.

8. The adaptive mobility device of claim 6 wherein the forearm support rest is mounted on the forearm support bar so as to pivot in a pitch motion with respect to the forearm support bar.

9. The adaptive mobility device of claim 8 wherein the forearm support rests are mounted to the forearm support bar by brackets that include a forward extending bar on which the at least one hand grip is adjustably mounted.

10. An adaptive mobility device comprising:

a frame having right and left frame portions joined at a forward vertex defining a midline plane and joined by a cross member extending between the right and left frame portions rearward from the vertex, the frame defining a space for a user rearward of the cross member;

a pair of rear forks, one attached to each of the right and left frame portions for supporting a pair of rear wheels rotatable about an axis approximately normal to the midline plane;

a front fork assembly having a central shaft pivotably supported by the frame at said vertex, and forks extending from the central shaft for rotatably supporting a front wheel steerable by altering the pivot angle of the front fork assembly;

a user weight support system including a forearm support bar mounted to a post pivotably supported by the cross member, and at least one hand grip mounted in a position suitable for gripping with a user's hand when the user's forearm is supported on the forearm support bar; and an adjustable steering mechanism for altering the pivot angle of the front fork assembly in response to a pivoting motion of the forearm support bar, the adjustable steering mechanism further configured to adjust the steering ratio.

11. The adaptive mobility device of claim 10 further comprising at least one U-shaped forearm support rest mounted to the forearm support bar.

12. The adaptive mobility device of claim 11 further comprising two forearm support rests mounted to the forearm support bar, one on either side of the midline and each spaced between about 5 and 15 inches from the midline.

13. The adaptive mobility device of claim 11 wherein the forearm support rest is mounted on the forearm support bar so as to pivot in a pitch motion with respect to the forearm support bar.

14. The adaptive mobility device of claim 12 wherein the forearm support rests are mounted to the forearm support bar by brackets that include a forwardly directed extension bar on which the at least one hand grip is adjustably mounted.

15. The adaptive mobility device of claim 14 wherein the at least one hand grip is adjustable in a fore and aft direction, and in a roll angle orientation.

16. The adaptive mobility device of claim 10 wherein the adjustable steering system further comprises a crank arm attached to the bottom of the forearm support post for pivot motion therewith; a lever arm attached to the front fork assembly for pivot motion therewith; and a tie link connecting the crank arm to the lever arm, wherein the tie link connects at one of either the crank arm or the lever arm to adjust the steering ratio.

17. The adaptive mobility device of claim 10 wherein the adjustable steering system further comprises a steering bar mounted to a top end of the central post of the front fork assembly for pivoting motion therewith; and a tie link connecting the forearm support bar to the steering bar, wherein the tie link to connects at one of on either the forearm support bar or the steering bar to adjust the steering ratio.

18. The adaptive mobility device of claim 17 wherein the at least one hand grip is mounted on the steering bar.

19. The adaptive mobility device of claim 10 wherein the wheels have a diameter that is more than 40% of the height of the device.

20. The adaptive mobility device of claim 10 further comprising a load sensor to monitor the amount of weight load a user transfers to the device.

* * * * *